US007169058B1

(12) United States Patent
Fagan

(10) Patent No.: US 7,169,058 B1
(45) Date of Patent: Jan. 30, 2007

(54) GOLF PUTTER HEAD HAVING MULTIPLE STRIKING SURFACES

(76) Inventor: Robert P. Fagan, 3503 Lennox View Ct., Louisville, KY (US) 40299

( * ) Notice: Subject to any disclaimer, the term of this patent is extended or adjusted under 35 U.S.C. 154(b) by 290 days.

(21) Appl. No.: 10/797,256

(22) Filed: Mar. 10, 2004

(51) Int. Cl.
*A63B 53/04* (2006.01)
*A63B 53/00* (2006.01)

(52) U.S. Cl. ..... 473/293; 473/313; 473/340; 473/330; 473/325

(58) Field of Classification Search ..... 473/286, 473/313, 325, 340, 341, 249, 293, 330; D21/736–746
See application file for complete search history.

(56) References Cited

U.S. PATENT DOCUMENTS

| | | | | | |
|---|---|---|---|---|---|
| 1,537,711 | A | | 5/1925 | Spafford | |
| 1,643,250 | A | | 9/1927 | Longsworth | |
| D106,293 | S | * | 10/1937 | Hilton | D21/738 |
| 3,064,975 | A | * | 11/1962 | Smith | 473/328 |
| 3,214,170 | A | | 10/1965 | Warnock | |
| D207,539 | S | | 5/1967 | Burkland | |
| D209,215 | S | * | 11/1967 | Long | D21/736 |
| D211,374 | S | * | 6/1968 | Hanson | D21/736 |
| 3,394,937 | A | * | 7/1968 | Allport | 473/293 |
| 3,399,898 | A | | 9/1968 | Burkland | |
| 3,652,093 | A | * | 3/1972 | Reuter, Jr. | 473/340 |
| 3,806,129 | A | * | 4/1974 | Burrows | 473/249 |
| D234,524 | S | | 3/1975 | Leander | |
| 3,873,094 | A | * | 3/1975 | Sebo et al. | 473/250 |
| 3,908,996 | A | | 9/1975 | Molinaro | |
| 3,944,231 | A | * | 3/1976 | Johnson | 473/286 |
| 4,010,958 | A | | 3/1977 | Long | |
| 4,147,357 | A | * | 4/1979 | Strop | 473/251 |
| D255,477 | S | | 6/1980 | Gida | |
| D257,783 | S | * | 1/1981 | Bernhardt | D21/741 |
| D264,367 | S | | 5/1982 | Gida | |
| 4,343,472 | A | | 8/1982 | Hamilton | |
| 4,508,342 | A | * | 4/1985 | Drake | 473/204 |
| 4,852,877 | A | | 8/1989 | Scalf | |
| 4,871,174 | A | * | 10/1989 | Kobayashi | 473/252 |
| 5,004,237 | A | * | 4/1991 | Antonious | 473/313 |
| 5,257,807 | A | * | 11/1993 | Baumann et al. | 473/312 |
| D346,191 | S | | 4/1994 | Bryant | |
| 5,383,664 | A | | 1/1995 | Epperson | |
| 5,415,399 | A | | 5/1995 | Kettelson | |
| 5,716,287 | A | | 2/1998 | Levocz et al. | |

(Continued)

*Primary Examiner*—Sebastiano Passaniti
(74) *Attorney, Agent, or Firm*—James E. Cole; Middleton Reutlinger

(57) ABSTRACT

The present invention provides a golf putter head that is suitable for putting a golf ball by either left-handed or right-handed golfers by swinging the putter in the typical pendulum motion or by pushing the putter in a shuffleboard-like motion. Further, the present invention provides a golfer with the ability to select the angle of the golf putter shaft to the golf putter head. The golf putter head comprises a top, a bottom, at least one flat striking surface, at least one curvilinear striking surface and a shaft receiving aperture. The top contains an insert having a variety of shaft receiving apertures. The shaft receiving apertures are of different angles to allow a golfer to pick the desired angle to better fit his or her needs. Further, the radii of the curvilinear striking surfaces are of such dimensions that the curvilinear striking surface, when used in the shuffleboard-like motion, strikes a golf ball above the golf ball's horizontal midline, which encourages topspin.

5 Claims, 8 Drawing Sheets

U.S. PATENT DOCUMENTS

| | | | | |
|---|---|---|---|---|
| 5,947,841 | A * | 9/1999 | Silvestro | 473/341 |
| 5,993,324 | A * | 11/1999 | Gammil | 473/251 |
| 6,183,380 | B1 * | 2/2001 | Yim | 473/330 |
| D443,664 | S | 6/2001 | Olson | |
| 6,595,867 | B2 * | 7/2003 | Sosin | 473/290 |
| D478,642 | S | 8/2003 | Spino | |
| 6,607,449 | B2 | 8/2003 | McCabe | |
| 6,616,545 | B2 | 9/2003 | Lacoste | |
| 2002/0061789 | A1 | 5/2002 | Yim | |
| 2002/0160855 | A1 | 10/2002 | Giraldi | |
| 2002/0198060 | A1 | 12/2002 | Fisher | |
| 2003/0064822 | A1 | 4/2003 | Arvidson | |
| 2003/0114240 | A1 | 6/2003 | Lacoste | |

* cited by examiner

GOLF PUTTER HEAD HAVING MULTIPLE STRIKING SURFACES

BACKGROUND OF THE INVENTION

The present invention relates to a head for a golf club more commonly known as a putter. A golf putter head that can be used to strike a golf ball with both a typical pendulum type motion and shuffleboard-like motion is desired. Additionally, a golf putter head used in a shuffleboard-like motion that does not become entangled with the ground and that encourages topspin when striking the ball is also desired. Further, a golf putter head that allows a golfer to select a shaft angle from a variety of preset angles and then to permanently affix the shaft at the desired angle is also desired.

BRIEF SUMMARY OF THE INVENTION

It is an object of the present invention to provide a golf putter head that is capable of striking a golf ball by using a standard pendulum motion or, if desired, a shuffleboard-like motion.

It is a further object of the present invention to provide a golf putter head that is capable of striking a golf ball using a shuffleboard-like motion without the putter head snagging or becoming entangled with the ground.

It is another object of the present invention to provide a golf putter head that is capable of encouraging topspin when a golf ball is struck using the putter in a shuffleboard-like motion.

It is another object of the present invention to provide a golf putter head that will accommodate a golf putter shaft at different angles relative to the putter head. Additionally, it is an object of the present invention to allow a golfer to select the desired angle of the shaft, from a variety of preset angles, and then to permanently affix the shaft at the selected angle.

It is another object of the present invention to provide a golf putter head capable of being used by both a left-handed or right-handed golfers for either striking a golf ball by using a standard pendulum motion or, if desired, a shuffleboard-like motion.

These and other objects are accomplished by a golf putter head having a top, a bottom, two flat striking surfaces, two curvilinear striking surfaces and a shaft receiving aperture.

DETAILED DESCRIPTION OF THE PREFERRED EMBODIMENT

Figure 1:
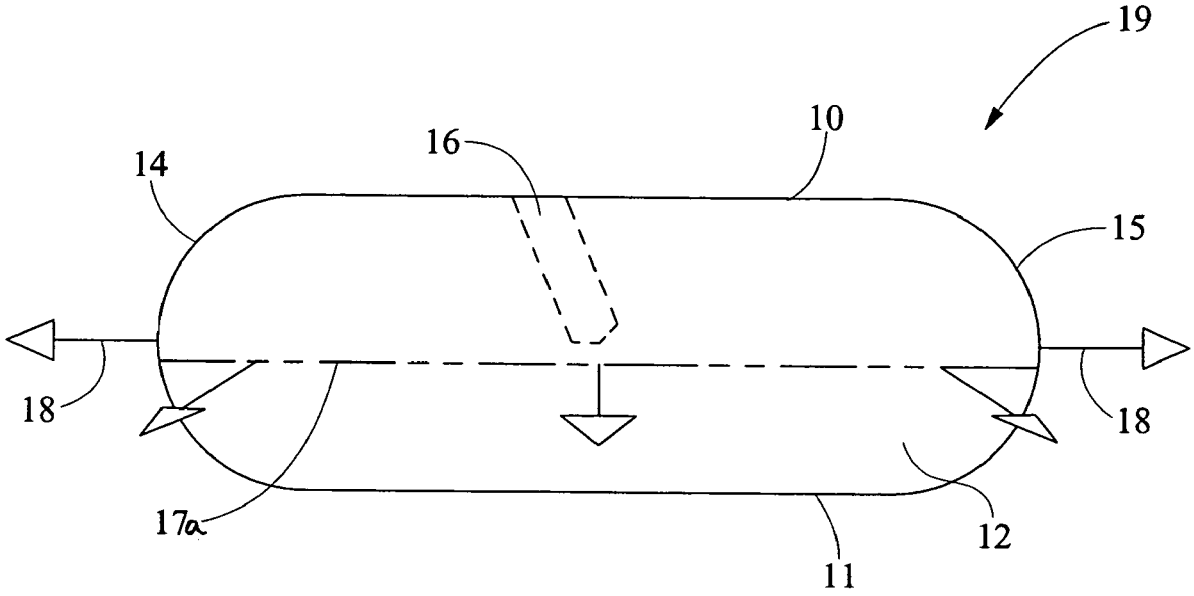
FIG. 1 is a side view of a golf putter head made in accordance with one embodiment of the present invention.
Figure 2:
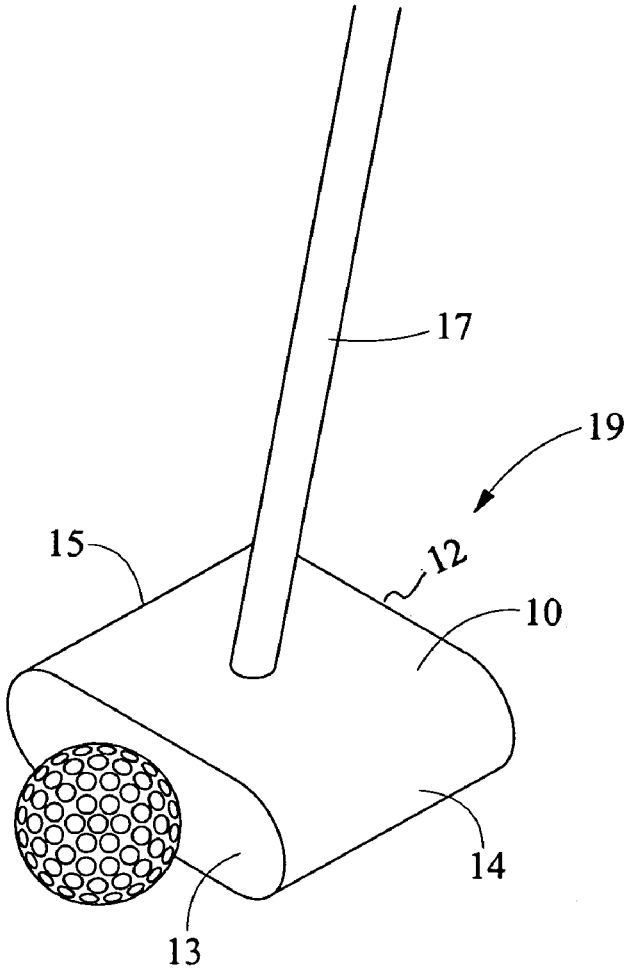
FIG. 2 is an isometric view of a golf putter head, made in accordance with the first embodiment, striking a golf ball with the substantially flat striking surface.
Figure 3:
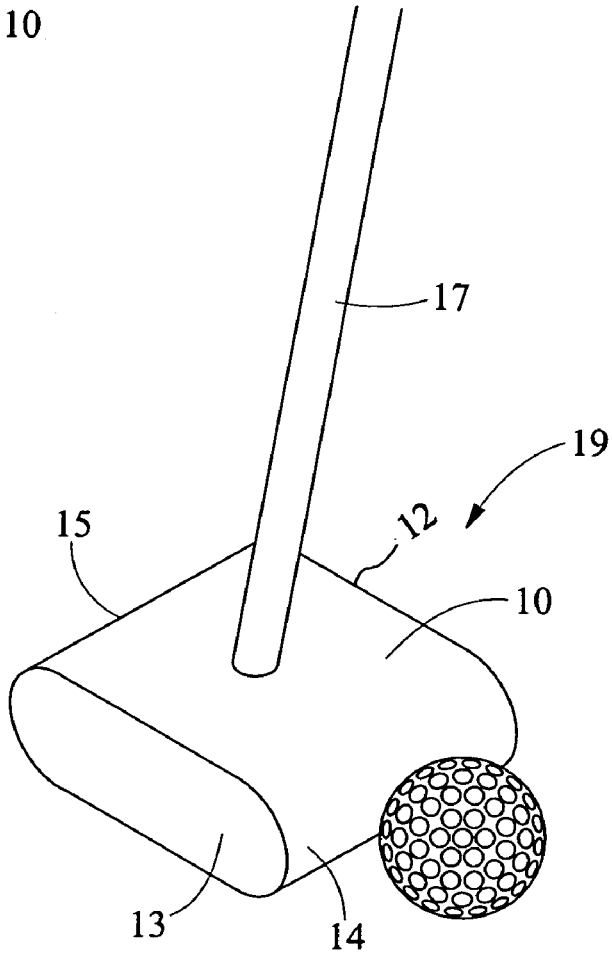
FIG. 3 is an isometric view of a golf putter head, made in accordance with the first embodiment, striking a golf ball with the curvilinear striking surface.

The golf putter head in its first embodiment 19, as shown in FIGS. 1, 2 and 3, comprises a putter having a top 10, a bottom 11, two flat striking surfaces 12 and 13 and two curvilinear striking surfaces 14 and 15 and an aperture 16. The golf putter head is preferably made from aluminum. However, one of skill in art will recognize that other materials may be utilized. The top 10 and bottom 11 are substantially flat. The aperture 16 is located on the top 10 and receives the base of a golf club shaft 17. The internal radii of the two curvilinear striking surfaces 14 and 15 can be of different dimensions but preferably range from 0.84 inches to 0.9375 inches. Accordingly, the height of the golf putter head, or distance between the top 10 and bottom 11, can be of different dimensions but preferably ranges from 1.68 inches to 1.875 inches. The width of the golf putter head, or distance between the two flat striking surfaces 12 and 13, can be of different dimensions but preferably ranges from 2.125 inches to 2.375 inches. The length of the golf putter head, or distance between the two curvilinear striking surfaces 14 and 15, can be of different dimensions but preferably ranges from 4.375 inches to 4.625 inches. One skilled in the art, however, will recognize that the size of the golf putter head can vary to better suit the needs of individual golfers.

The design of the golf putter head allows a golf ball to be struck with two different motions. First, the golf putter head can be used in the conventional method by grasping the shaft 17 and swinging the golf putter head with a pendulum or putting swing motion striking the golf ball, as shown in FIG. 2, with either of the two flat striking surfaces 12 or 13. Second, the golf putter head can be used by grasping the shaft 17 and pushing the golf putter head in a shuffleboard-like motion, striking the golf ball, as shown in FIG. 3, with either of the two curvilinear striking surfaces 14 or 15. Because the golf putter head provides two flat striking surfaces 12 and 13, the golf putter head when swung using a pendulum motion can be used by both right-handed and left-handed golfers. Similarly, the golf putter head can be used via the shuffleboard-like motion by both right-handed and left-handed golfers.

Further, when the putter is used with a pendulum motion to strike a golf ball with either of the two flat striking surfaces 12 or 13, the striking surface will contact the golf ball at a point, referred to as the first striking line 17*a*, on the flat striking surface 12 or 13 that coincides with the horizontal midline of the golf ball. In other words, when the putter is swung in a pendulum motion with either of the two flat striking surfaces 12 or 13 perpendicular to the horizontal midline of a golf ball, the golf ball will be struck at its midline regardless of where the golf ball contacts the flat striking surface 12 or 13.

When the putter is used with a shuffleboard-like motion to strike a golf ball with either of the two curvilinear striking surfaces 14 or 15, the striking surface will contact the golf ball at a point, referred to as the second striking line 18, on the curvilinear striking surface 14 or 15 that coincides with a point on the golf ball equal to or higher than its horizontal midline. In other words, the preferred radii of the two curvilinear striking surfaces 14 and 15 are of such dimensions that when the golf putter head is used in the shuffleboard-like motion, as shown in FIG. 3, and a golf ball is struck with either of the two curvilinear striking surfaces 14 or 15 the golf ball is struck above its horizontal midline, causing the golf ball to have a topspin at impact. The topspin created at impact is advantageous in that it helps the golf ball begin rolling without skipping, sliding or bouncing. Further, the two curvilinear striking surfaces 14 and 15 provide relief from the ground in that there is are no sharp corners leading from the curvilinear striking surfaces 14 and 15 to the bottom 11. This relief allows the golf putter head to be pushed in the shuffleboard-like motion without the putter getting entangled with the ground.

Figure 4:
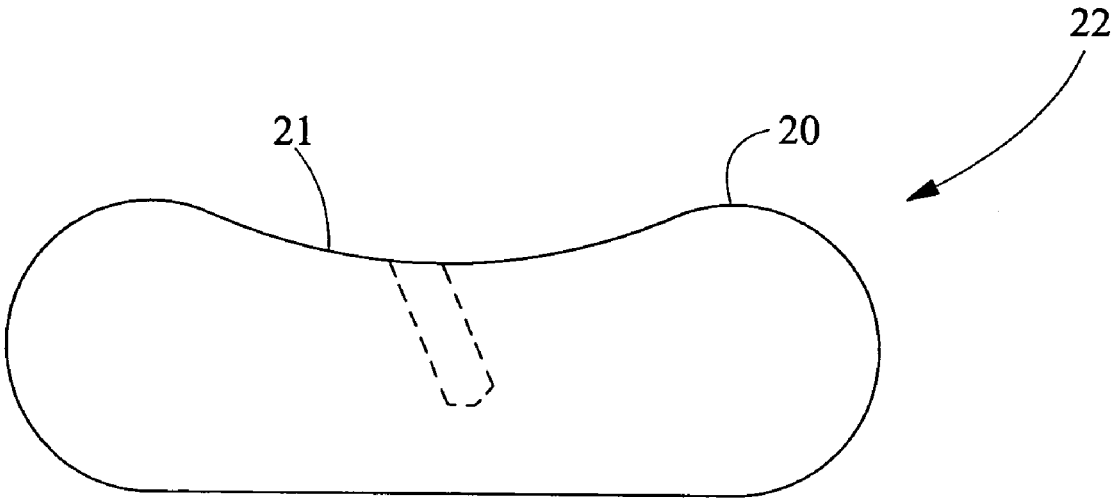
FIG. 4 is a side view of a golf putter head made in accordance with a second alternate embodiment of the present invention.

FIG. 4 shows a second alternate embodiment having generally the features of the first embodiment in FIGS. 1, 2 and 3 except that the top 20 of the golf putter head 22 contains a concaved portion 21. The radius of concaved portion 21 can be of different dimensions but preferably is 1 inch.

Figure 5:
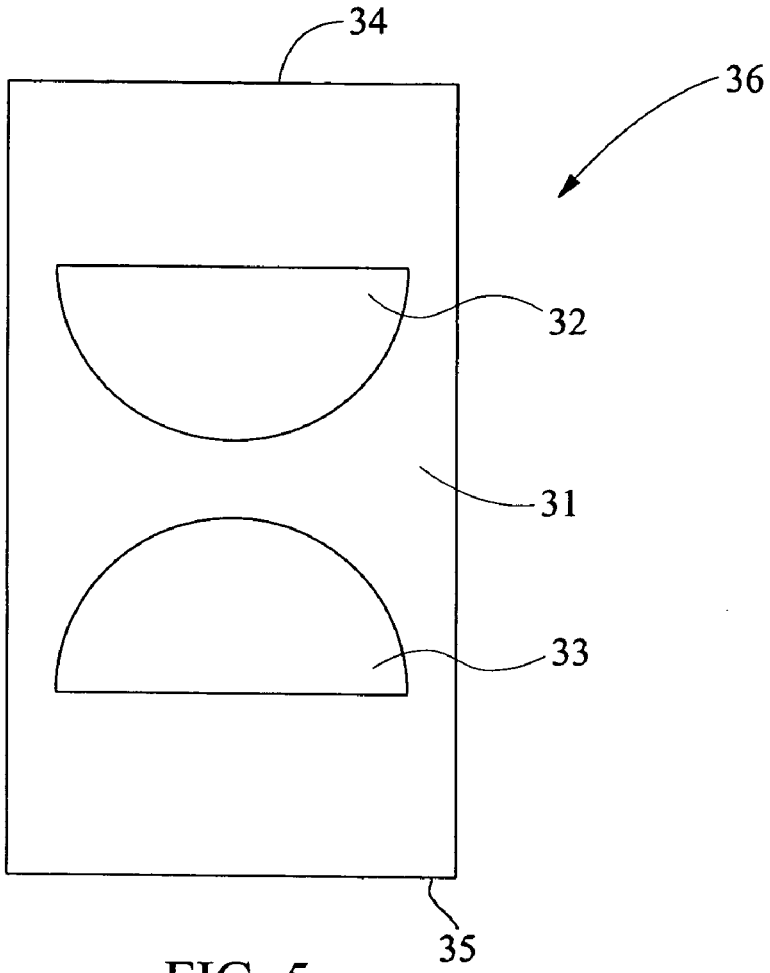
FIG. 5 is a bottom view of a golf putter head made in accordance with a third alternate embodiment of the present invention.
Figure 6:
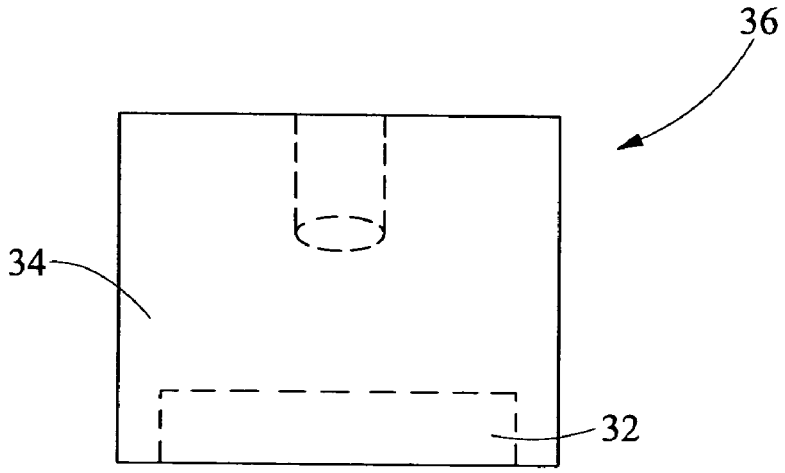
FIG. 6 is an end view of a golf putter head made in accordance with the third alternate embodiment of the present invention.
Figure 7:
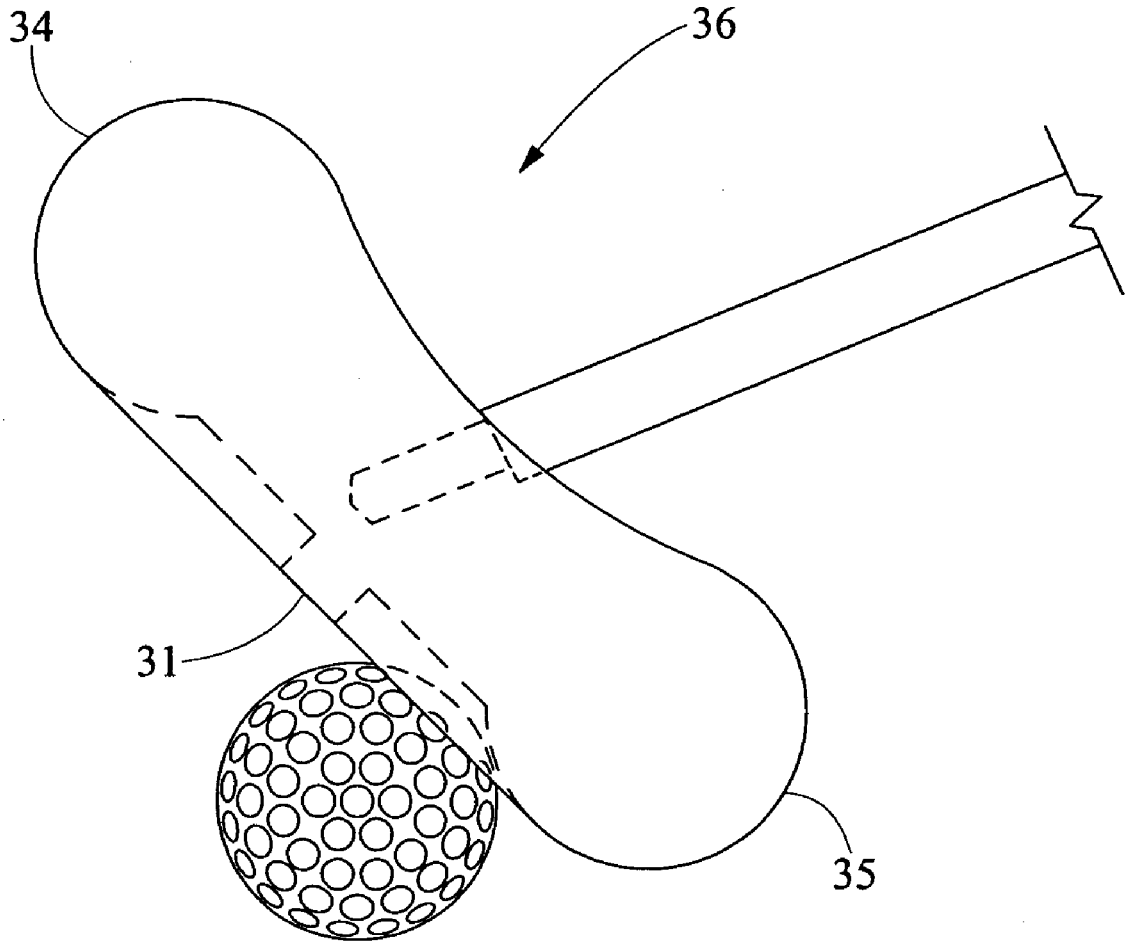
FIG. 7 is a side view of a golf putter head made in accordance with the third alternate embodiment, striking a golf ball with the curvilinear striking surface.

FIGS. 5 and 6 show a third alternate embodiment having generally the features of the second embodiment as shown in FIG. 4 except that the bottom 31 of the golf putter head 36 contains two recessed portions 32 and 33. These recessed portions 32 and 33 can be of any shape but are preferably semicircular. Additionally, the recessed portions 32 and 33 can be of any depth but are preferably ¼ inch deep. The recessed portions 32 and 33 function to provide clearance for the golf ball when the golf putter head is positioned and pushed in the shuffleboard-like motion striking the golf ball as shown in FIG. 7. The recessed portions 32 and 33 allow the golf ball to be struck with either of the curvilinear striking surfaces 34 or 35 without the golf ball coming into contact with the bottom 31.

Figure 8:
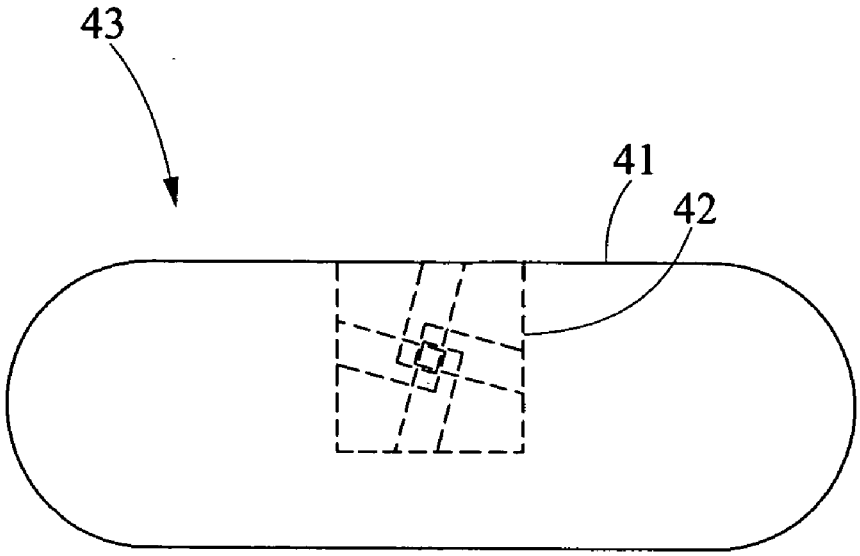
FIG. 8 is a side view of a golf putter head made in accordance with a fourth alternate embodiment of the present invention.
Figure 9:
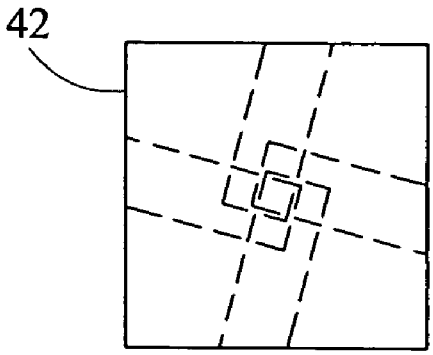
FIG. 9 is a side view of an insert as shown in FIG. 8.

FIG. 8 shows a fourth alternate embodiment having generally the features of the first embodiment in FIG. 1 except that the top 41 of the golf putter head 43 contains an insert 42. The insert 42, as better seen in FIG. 9, is generally six-sided with each side capable of containing an aperture. Preferably, the insert 42 contains one aperture on each of four sides of the insert with one of each apertures being at an angle of 12.5 degrees, 15 degrees, 17.5 degrees and 20 degrees from vertical. The insert 42 allows the golfer to vary the angle of the golf club shaft by placing the insert 42 into the top 41 with the desired, angled aperture exposed. Once the desired aperture is selected, the insert 42 can be affixed within the golf putter head by using an adhesive. Thereafter, the base of a golf putter shaft can be affixed within the exposed aperture.

Figure 10:
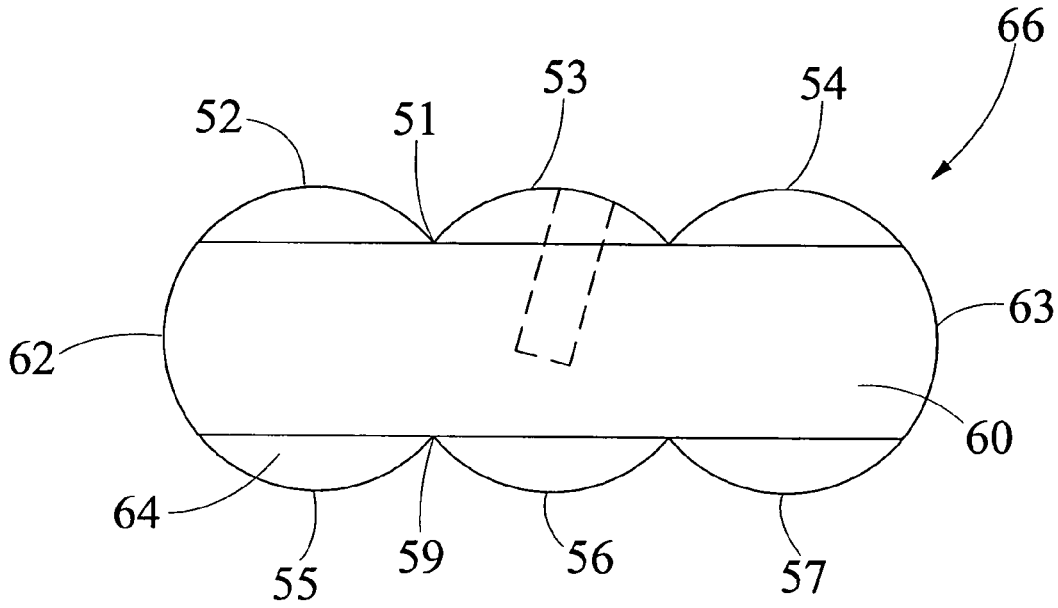
FIG. 10 is a side view of a golf putter head made in accordance with a fifth alternate embodiment of the present invention.
Figure 11:
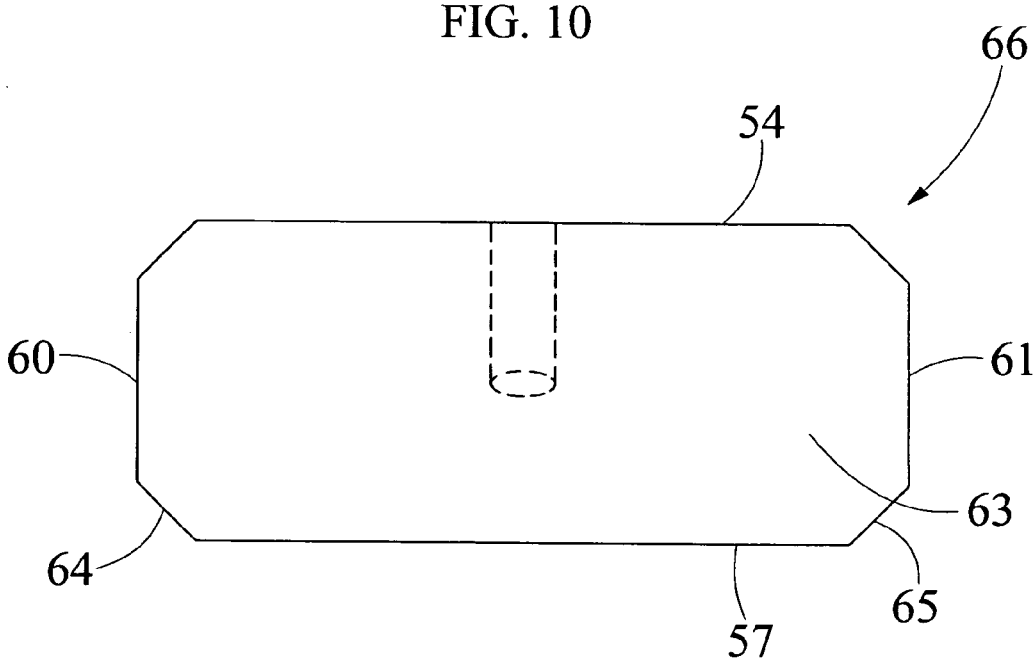
FIG. 11 is an end view of a golf putter head made in accordance with the fifth alternate embodiment of the present invention.

Referring to FIGS. 10 and 11, a fifth alternate embodiment is shown wherein the top 51 of the golf putter head 66 has three convex portions 52, 53 and 54. Likewise, the bottom 59 has three convex portions 55, 56 and 57. The radii of convex portions 52 through 57 are of equal dimensions. Preferably, the convex portions 52 through 57 have radii ranging from 0.8125 inches to 0.9375 inches. Alternatively, the convex portions 53 and 56 have radii of equal dimensions but less than those radii of convex portions 52, 54, 55 and 57. The convex portions 55, 56 and 57 of bottom 59 result in less surface area coming in contact with the ground when the golf putter head is pushed using the shuffleboard-like motion. Also, the golf putter head, as in the preferred embodiment, has two flat striking surfaces 60 and 61 and two curvilinear striking surfaces 62 and 63. Further, the bottom 59 has two beveled edges 64 and 65 located adjacent to the two flat striking surfaces 60 and 61. The beveled edges 64 and 65 provide relief from the ground so that the golf putter head can be swung with a pendulum like motion when using either of the two flat striking surfaces 60 and 61 without the flat striking surface 60 and 61 getting entangled with the ground. What is more, as in the preferred embodiment, the golf putter head shown in FIGS. 10 and 11 can also be used in a shuffleboard-like motion striking a golf ball with either of the two curvilinear striking surfaces 62 and 63.

Figure 12:
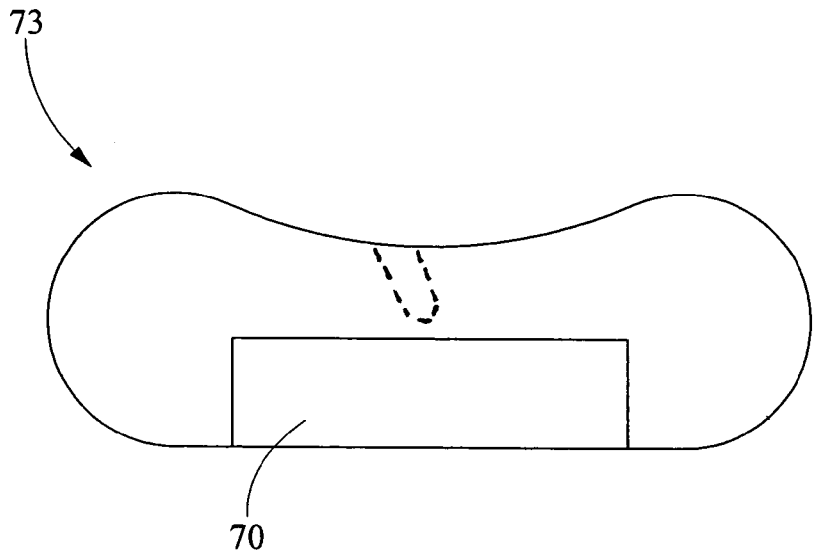
FIG. 12 is a side view of a golf putter head made in accordance with a sixth alternate embodiment of the present invention.

Referring to FIG. 12 a sixth alternate embodiment is shown having generally the features of the second embodiment shown in FIG. 4 except that the golf putter head 73 contains an inset 70. The inset 70 is flush with the two flat striking surfaces and is composed of material different from that of the two flat striking surfaces. The inset 70 is preferably made of Delrin® plastic. However, one of skill in the art will recognize that other materials may be used. The inset 70 provides a striking surface with a different hardness. As a result, the inset 70, depending on the material used, provides a different feel when striking a golf ball.

Figure 13:
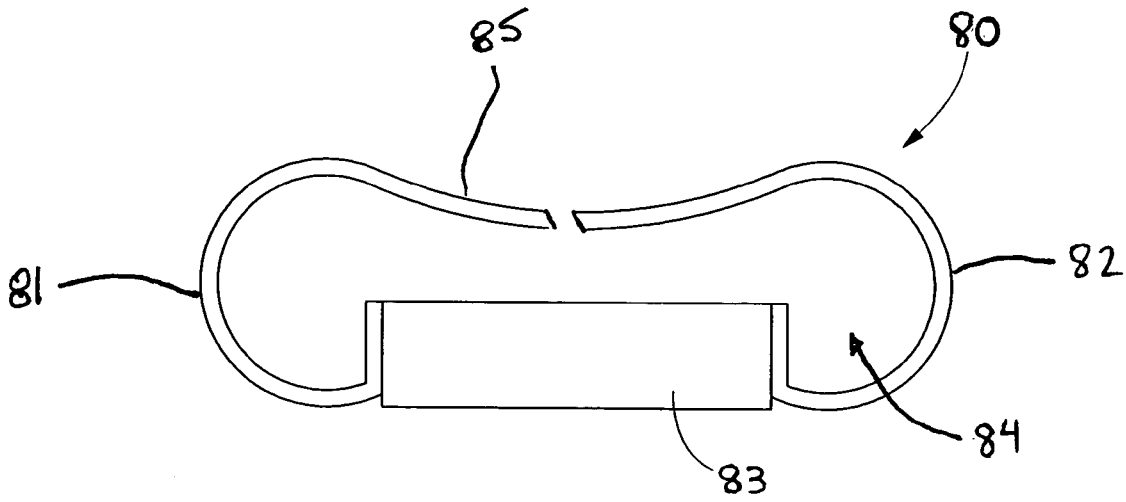
FIG. 13 is a side view of a golf putter head made in accordance with a seventh alternate embodiment of the present invention.

Referring to FIG. 13, a seventh alternate embodiment is shown having generally the features of the sixth embodiment in FIG. 12 except that the golf putter head 80 has a top 85 and curvilinear striking surfaces 81 and 82 formed from a sheet of material. In other words, the material forming the top 85 and curvilinear striking surfaces 81 and 82 and the inset 83 form an aperture 84.

The detailed description contained hereinabove shall not be construed as a limitation of the following claims, as it will be readily apparent to those skilled in the art that design choices may be made changing the materials, construction, or configuration of the golf putter head without departing from the spirit and scope of the claimed invention.

The invention claimed is:

1. A golf putter head, comprising:

a top, a bottom, opposed flat striking surfaces, opposed curvilinear striking surfaces and a shaft receiving aperture;

said flat striking surfaces having a first striking line extending parallel to said flat striking surfaces;

a first cylindrical portion and a second cylindrical portion defining said curvilinear striking surfaces, said curvilinear striking surfaces having second striking lines at a toe end of said first striking line and at a heel end of said first striking line, each of said second striking lines extending parallel to the axis of said cylindrical portions and substantially perpendicular to said first striking line;

at least one recess along said bottom disposed between said first and second cylindrical portions; and, said second striking lines being located at a distance higher from said bottom than said first striking line when said first cylindrical portion and said second cylindrical portion are contacting said substrate.

2. The golf putter head of claim 1 wherein said curvilinear striking surfaces have an interior radius ranging from 0.84 inch to 0.9375 inch.

3. The golf putter head of claim 1 wherein said top has a concave portion.

4. The golf putter head of claim 3 wherein said concave portion has a radius of 0.875 inch to 1.0 inch.

5. A golf putter head, comprising:

a top surface and a bottom surface;

at least one flat surface for striking a golf ball extending between said top and bottom surfaces;

first and second ends connecting said top and bottom surface and said at least one flat surface, said first and second ends being generally cylindrical in shape defining a curvilinear surface and at least a second location for striking said golf ball;

said at least second striking locations at a toe end of said first striking surface and at a heel end of said first striking surface being perpendicular to said first striking locations;

at least one recess disposed between said first and second cylindrical ends adjacent said bottom surface;

said curvilinear end surfaces each having a radius which is greater than a radius of a golf ball such that a second strike line is higher than a first strike line when said first strike line is parallel to the ground.

* * * * *